United States Patent [19]

Hitchins

[11] Patent Number: 4,604,827

[45] Date of Patent: Aug. 12, 1986

[54] HINGED WINDOW-GUARD ASSEMBLY

[76] Inventor: William G. Hitchins, "Fiddawn", New Cascade Road, Norfolk Island, 2899, Australia

[21] Appl. No.: 758,083

[22] Filed: Jul. 23, 1985

[30] Foreign Application Priority Data

Jun. 11, 1985 [AU] Australia ..... PH0983

[51] Int. Cl.[4] ..... E06B 3/68

[52] U.S. Cl. ..... 49/57; 49/467

[58] Field of Search ..... 49/50, 57, 198, 464

[56] References Cited

U.S. PATENT DOCUMENTS

| | | | |
|---|---|---|---|
| 2,402,112 | 6/1946 | Gee | 49/464 X |
| 2,878,536 | 3/1959 | Becker | 49/464 X |
| 3,381,416 | 5/1968 | De Torres et al. | 49/464 |
| 3,745,704 | 7/1973 | Covington | 49/57 |

*Primary Examiner*—Kenneth Downey

*Attorney, Agent, or Firm*—Anthony A. O'Brien

[57] ABSTRACT

A window guard assembly comprising a frame extending around three sides of a window opening and a shutter element received in the frame. The frame comprises channel sections and includes two vertical elements with a horizontal element fixed to the lower ends thereof; and with the channel sections facing one another to receive the shutter. One vertical element includes an upper section which is hinged to open its channel. The shutter comprises a lower section which slides vertically into the lower fixed frame and an upper section which slides horizontally into the upper frame when the hinged sections is opened. The shutter sections are horizontally corrugated and one section is provided with staggered leaves along its meeting edge into which the opposed edge of the other shutter section seats when installed.

5 Claims, 3 Drawing Figures

-FIG. 1-
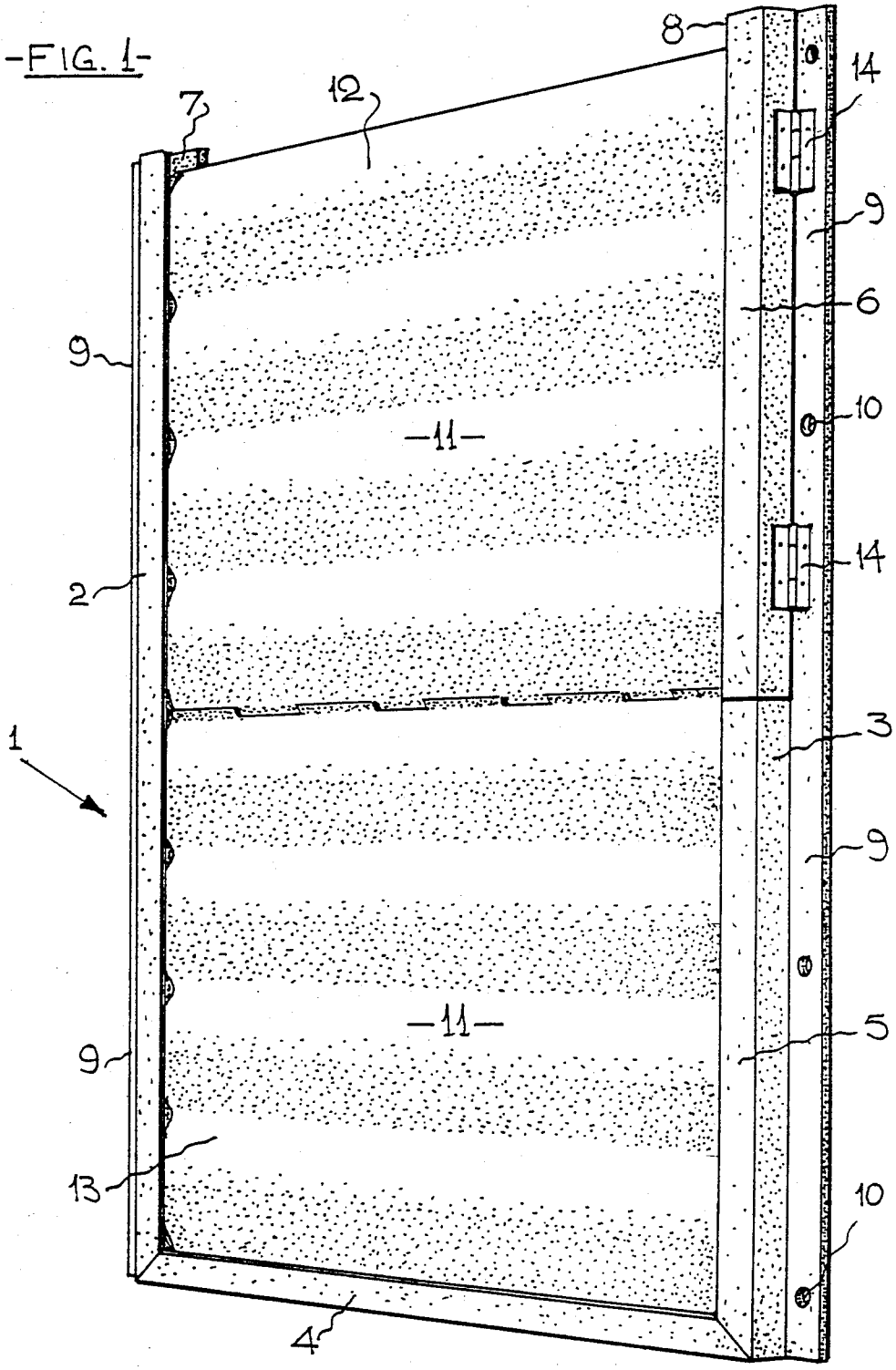

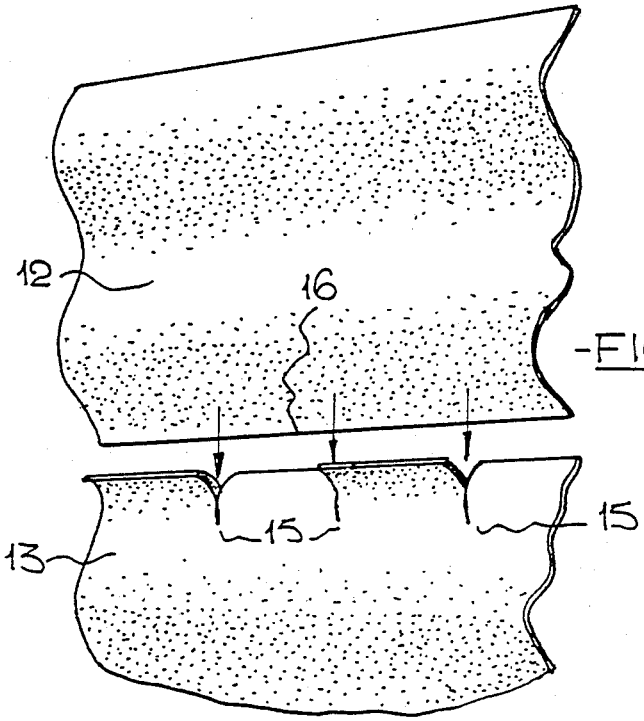
-FIG. 2-
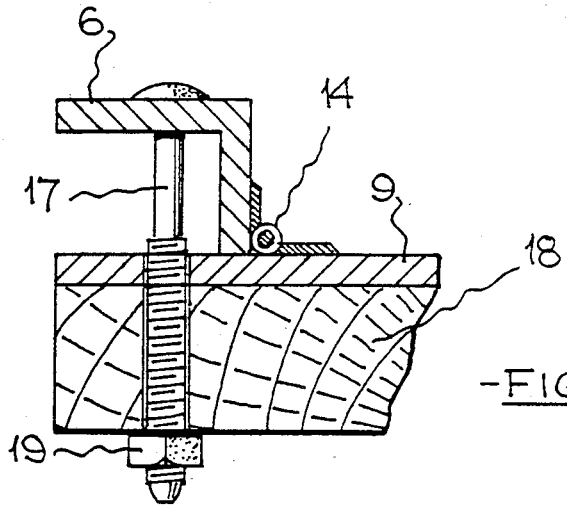
-FIG. 3-

HINGED WINDOW-GUARD ASSEMBLY

This invention relates to storm shutters and the like closures for windows, and more particularly to a window guard assembly having an entirely new constructional concept and which is attractive in appearance as well as being inexpensive to produce.

The invention is an improvement in or modification of the "main " invention which is the subject of Australian Patent Application No. 72780/81, hereinafter termed the "parent" application.

In the preamble to the specification of the parent application it was stated that many densely populated areas are subject to storms, hurricanes, typhoons and the like from time to time, and in some of these areas the windows of buildings are often furnished with storm shutters of various kinds to protect them from breakage by debris entrained in the wind and thrown violently against them. Sometimes a whole window may be "blown in" by a high-velocity gust.

The conventional storm shutter is usually provided with numerous items of hardware such as catches, hasps, locks and the like fittings, and these items are prone to damage from various causes, particularly the buffetting received during severe wind gusts. Consequently, such conventional shutters have short working lives and frequently fail just when they are most needed.

It has now been found that, while the window guard assembly of the parent application was usable only when the lintel or head of the window to be protected was located 12 inches or more from an eave-line or a soffit, a quite simple variation will permit the shutter element to be placed in position easily when the lintel approaches very closely to the soffit.

Therefore, to this end there is provided a window guard assembly comprising a frame element adapted to be affixed to, and to extend about, three sides of a surround of a window opening, and a shutter element receivable in said frame element;

said frame element consisting of three sub-elements each of channel-shaped cross section and having their appropriate respective ends joinable so as to constitute three sides of a rectangle, two of which are adapted to extend vertically adjacent the sides of said window opening and the other of which is adapted to extend horizontally adjacent the lower sill of said window opening, the mouths of the said three channel-shaped sub-elements facing inwardly to thereby define a continuous inwardly-opening channel about the three sides of said window opening; one of said vertically-extending sub-elements being formed in two vertically-juxtaposed portions, the upper one of which is side-hinged so as to be able to be swung outwardly; said shutter element being composed of at least two portions of horizontally-corrugated cross-section, an upper horizontal edge of each portion except the topmost one being formed so as to be able to receive therein a plane edge of an adjacent portion; said shutter element being dimensioned so as to be able to be held snugly, by its lower and side marginal portions, within the said continuous channel when the said hinged upper portion is in the closed position; the arrangement being such that, by virtue of the said hinged upper portion, said shutter element is slidable sideways into said frame element when the lintel of the window closely approaches an eave-line or soffit.

The or each said upper horizontal edge may be provided with a plurality of spaced-apart vertical cuts, adjacent portions of the edge being bent in alternate directions to constitute a horizontal slot adapted to receive therein a said plane edge of a said adjacent portion of said shutter member.

Ideally, the frame element may be made from plastic or it may be extruded aluminium or aluminium alloy, while the shutter element is advantageously of galvanised iron, plastic material, or is of extruded aluminium or aluminium alloy.

In order that the reader may gain a better understanding of the present invention, hereinafter will be described a preferred embodiment thereof, by way of example only, and with reference to the accompanying drawings in which:

FIG. 1 is a perspective view of the hinged window guard assembly according to the present invention;

FIG. 2 shows how an upper and a lower shutter element may be fitted together; and FIG. 3 is a cross-section through a hinged sub-element portion, showing how a window guard may be secured in position over a window.

In FIG. 1 it will be seen that a frame element, generally referenced 1, extends about three sides of the surround of a window opening to be protected. This frame element 1 is composed of three sub-elements 2, 3 and 4, of channel-shaped cross-section and preferably of extruded aluminium or aluminium alloy, or even of a suitable plastic material, with their appropriate respective ends joined so as to constitute three sides of a rectangle as will be seen. Sub-element 2 extends vertically adjacent the one side of the window opening while sub-element 4 extends horizontally adjacent the sill or bottom side of the opening. Sub-element 3 also extends vertically adjacent the other side of the window opening but is divded into a lower portion 5 and a hinged upper portion 6, to be referred to again hereinafter. The mouths of the channels of the two vertical sub-elements 2 and 3 open inwardly so as to face each other, while the channel of the horizontal sub-element 4 is upwardly opening. Thus there is defined a continuous, inwardly-opening channel extending about the three sides of the window opening. In the interests of simplicity of manufacture, the upper ends 7 and 8 of vertical sub-elements 2, 3 may be left open, although caps consisting of, say, a plastic material could be fitted over them to exclude rain, snow etc. Vertical sub-elements 2 and 3 extend upwardly as far as the head or lintel of the window opening even if the latter very closely approaches the eave-line or soffit of a building. Ideally, hinged upper portion 6 may be about 15 inches in height.

The frame element 1 may be provided with means for securing it to such structures as a wall or window frame, and these means may advantageously take the form of flanges 9 extending from the sub-elements. Flanges 9 may have holes 10 provided therein or they may be affixed simply by nails driven through them.

While the foregoing description of frame element 1 has been couched in terms of extruded sub-elements 2, 3 and 4, attachable to a surround or window frame, it is also envisaged that such sub-elements may equally well be extruded integrally with window frame members of that kind in which four such may be joined to constitute a complete window frame where a window to be protected is exceptionally wide. Two channel-section sub-elements may be employed, disposed web-to-web and attached to a vertical mullion of the window frame. Preferred, however, would be an extruded sub-element of H-section.

Turning again to FIG. 1, a shutter element 11 is receivable in frame element 1, shutter element 11 being composed of at least two portions, such as 12 and 13, of a material of horizontally-corrugated cross-section. This shutter element is so dimensioned as to be able to be held snugly within the three-sided continuous inwardly-opening channel defined by sub-elements 2, 3 and 4 of frame element 1.

Shutter element portions 12 and 13 may be extrusions of aluminium or aluminium alloy, or a suitable plastic material, but perhaps the best material is galvanised corrugated iron sheet. Needless to say, since shutter element 11 is to fit into the channels of frame element 1, which surrounds on three sides the window to be protected, the shutter element itself will be of such a size as to fully overlie and thus shield the window to which the guard is to be fitted.

To place the shutter element portions into the frame element, hinged upper portion 6 is swung outwardly on its hinges 14 and the lower shutter element portion 13 is slid down into place, this being aided by the flexing of the element as it is manipulated. The upper shutter element portion 12 is now slid down to mate with portion 13 in a way to be later described herein. The pitch of the corrugations should be such that a small amount of force will be needed to push the shutter element portions into the channels of the frame element, so slightly flattening out the corrugations and ensuring a tight fit by virtue of the inherent resilience of the corrugated material. The upper hinged portion 6 is then swung back and secured in some suitable way.

The mating of the upper and lower portions 12 and 13 of shutter element 11 may be simply accomplished as shown in FIG. 2. The upper horizontal edge of lower portion 13 is provided with a series of spaced-apart vertical cuts 15 which allow sections of the edge to be bent outwardly in alternate directions. The resulting horizontal "intermittent slot" will thus receive the lower horizontal edge 16 of upper portion 12 of shutter element 11.

FIG. 3 shows how a window guard assembly may be secured in position over a window; such a simple arrangement being particularly applicable to such as site offices and other "lock-up" buildings. Through hinged upper portion 6 and underlying flange 9 extends a threaded bolt 17, this latter passing through the window frame, such as 18, and being secured by a nut 19 inside the building.

It is contemplated that the hinged window guard assemblies of the present invention may well be retailed in "knocked-down" form with, say, the three sub-elements not pre-joined but ready to be united into three-sided format by the purchaser by, say, screwing them together or otherwise.

It is also contemplated that the inventive hinged window guard assemblies may be offered in a wide range of colours of colour combinations to be compatible and in harmony with the colour scheme of the building upon which they are to be installed.

From the foregoing, the reader will readily appreciate that hinged window guard assemblies made in accordance with the present invention will provide the public with a new or much-improved article or, at the very least, ofer to it a useful and attractive choice.

The claims defining this invention are as follows:

I claim:

1. A window guard assembly comprising a frame element adapted to be affixed to, and to extend about, three sides of a surround of a window opening, and a shutter element receivable in said frame element;

said frame element consisting of three sub-elements each of channel-shaped cross section and having their appropriate respective ends joinable so as to constitute three sides of a rectangle, two of which are adapted to extend vertically adjacent the sides of said window opening and the other of which is adapted to extend horizontally adjacent the lower sill of said window opening, the mouths of the said three channel-shaped sub-elements facing inwardly to thereby define a continuous inwardly-opening channel about the three sides of said window opening; one of said vertically-extending sub-elements being formed in two vertically-juxtaposed portions, the upper one of which is side-hinged so as to be able to be swung outwardly; said shutter element being composed of at least two portions of horizontally-corrugated cross-section, an upper horizontal edge of each portion except tthe topmost one being formed so as to be able to receive therein a plane edge of an adjacent portion; said shutter element being dimensioned so as to be able to be held sungly, by its lower and side marginal portions, within the said continuous channel when the said hinged upper portion is in the closed position; the arrangement being such that, by virtue of the said hinged upper portion, said shutter element is slidable sideways into said frame element when the lintel of the window closely approaches an eave-line or soffit.

2. The window guard assembly as claimed in claim 1, wherein the or each said upper horizontal edge is provided with a plurality of spaced-apart vertical cuts therein, adjacent portions of said edge being bent in alternate directions to constitute a horizontal slot adapted to receive therein a said plane edge of a said adjacent portion of said shutter element.

3. The window guard assembly as claimed in claim 1, wherein said frame element is provided with means for securing it to the surround of said window opening.

4. The window guard assembly as claimed in claim 1, wherein said frame element is made of plastic material, or of extruded aluminium or aluminium alloy.

5. The window guard assembly as claimed in claim 1, wherein said shutter element is made of galvanised iron, plastic material, or of extruded aluminium or aluminium alloy.

* * * * *